US005287794A

United States Patent [19]

Andersson

[11] Patent Number: 5,287,794

[45] Date of Patent: Feb. 22, 1994

[54] HYDRAULIC MOTOR WITH INLET FLUID SUPPLEMENTED BY FLUID FROM CONTRACTING CHAMBER

[76] Inventor: Bo Andersson, Junistigen 10, S-931 52 Skellefteå, Sweden

[21] Appl. No.: 734,644

[22] Filed: Jul. 23, 1991

[30] Foreign Application Priority Data

Jul. 24, 1990 [SE] Sweden ..... 9002494-4

[51] Int. Cl.[5] ..... F15B 11/08

[52] U.S. Cl. ..... 91/436; 91/461

[58] Field of Search ..... 91/421, 436, 437, 440, 91/461, 462

[56] References Cited

U.S. PATENT DOCUMENTS

| | | | |
|---|---|---|---|
| 3,151,455 | 10/1964 | Tennis | 91/461 X |
| 3,433,131 | 3/1969 | Soyland et al. | 91/461 X |
| 3,470,792 | 10/1969 | Darling | 91/421 X |
| 3,996,840 | 12/1976 | Futamata et al. | 91/461 X |
| 4,362,018 | 12/1982 | Torii | 91/436 X |
| 4,437,385 | 3/1984 | Kramer et al. | 91/461 X |
| 4,611,528 | 9/1986 | Nanda et al. | 91/461 X |

FOREIGN PATENT DOCUMENTS

| | | | |
|---|---|---|---|
| 0014603 | 2/1981 | Japan | 91/461 |
| 0005502 | 2/1983 | Japan | 91/461 |
| 0021005 | 2/1983 | Japan | 91/461 |

*Primary Examiner*—Edward K. Look
*Assistant Examiner*—John Ryznic
*Attorney, Agent, or Firm*—Burns, Doane, Swecker & Mathis

[57] ABSTRACT

An arrangement intended for controlling hydraulic motors and comprising inlet elements (17, 18) and outlet elements (7, 5) in the form of valves arranged in a hydraulic circuit which connects the hydraulic motor (1) with a pump (15) which functions as a power source for at least the hydraulic motor (1) and preferably, but not necessarily, for one or more further hydraulic motors, and also to a tank (9). Each inlet element (17, 18) is mounted in the hydraulic circuit on the pressure side of the pump, whereas each outlet element (5, 7) is mounted in the hydraulic circuit on the suction side of the pump. The arrangement is characterized in that each inlet element (17, 18) detects the pressure prevailing in the hydraulic circuit at a location between the hydraulic motor (1) and the outlet element (7, 5), and is also controlled by this detected pressure on load lowering occasions in accordance with a separately applied control-pressure, such as to steer the flow of fluid from one piston side of the hydraulic motor to the other piston side thereof and relieve the pump (15) of load.

18 Claims, 4 Drawing Sheets 8 el. 6
28 el. 27
P

HYDRAULIC MOTOR WITH INLET FLUID SUPPLEMENTED BY FLUID FROM CONTRACTING CHAMBER

The present invention relates to an arrangement for controlling hydraulic motors, both linear motors, for instance hydraulic piston-cylinder devices, and rotating or oscillating motors, such as torque motors, said arrangement including inlet and outlet elements in the form of valves disposed in a hydraulic circuit which connects the hydraulic motor to the pressure side of a pump, which functions as a power source, and to a tank on the suction side of said pump.

As is well known, each hydraulic motor subjected to load in a mobile hydraulic system is acted upon by a force which is contingent on the load and, if the hydraulic motor is to be capable of moving its load in a controlled fashion in one direction or the other, it is necessary to couple the motor to a pump via a hydraulic line, here called the supply line, and also to a tank via a hydraulic line, here called the exhaust line, irrespective of whether the load is to be lifted or lowered. No known mobile directional valve is able to detect whether it is a lifting-load or a lowering-load that is to be moved, and it is necessary to maintain the pump of the mobile hydraulic system constantly connected to the inlet line of the hydraulic motor concerned, irrespective of whether the load to be moved is a lifting-load or a lowering-load. Thus, the hydraulic motor is forced to consume pump flow even in the case of lowering-loads, despite the fact that such consumption is not actually necessary, since the actual motor itself should be capable of drawing-in hydraulic medium from the tank conduit or line. The problem in this respect is that even when moving lowering-loads, it is necessary to fill the cylinder chamber of the hydraulic motor on the suction side rapidly, since if the chamber is not filled quickly enough a subpressure is generated in the cylinder chamber, resulting in troublesome gravitational problems.

For example, if the line leading to a loaded hydraulic motor forming part of a mobile hydraulic system should fracture, the load would undoubtedly sink, which must be prevented for safety reasons. Consequently, mobile hydraulic systems are fitted with so-called over-centre valves which function as load-control valves and which are incorporated in the one line between the hydraulic cylinder and its directional valve and are controlled by pressure in the other line between the hydraulic cylinder and its directional valve, this pressure being contingent on the prevailing pump pressure. If this pressure fails, the over-center valve is cut-off automatically, thereby preventing the load from dropping or sinking.

Thus, the function of valves used to prevent load-sinking are dependent on both pump pressure and pump flow. When taking into account the fact that, for example, in the case of hydraulic lifting devices, as seen generally, half of all movements performed by each loaded hydraulic motor consists of lifting movements and the other half of lowering movements, it will be seen that many advantages are afforded when the pump flow required for lowering movements in known hydraulic systems can be used for other purposes, for example for other hydraulic motors included in the hydraulic system.

Mobile hydraulic systems often include several hydraulic motors which are served by one single pressure source or pump, and since, in mobile applications, access to hydraulic flow is always limited, so to speak, important advantages would be gained if it were possible to eliminate one or more of the "unnecessary" flows required in known mobile hydraulic systems.

Accordingly, the object of the present invention is to solve the aforesaid problems associated with the unnecessary fluid flows that occur in known mobile hydraulic systems and therewith increase the availability of pump flow to a corresponding extent for other purposes within the system, and more specifically to provide an arrangement in hydraulic motors which is so constructed as to enable the pump of the hydraulic system to be relieved of load automatically in the load-lowering mode of said system.

For the sake of clarity, it can also be mentioned that by lowering-load is meant here a load which does not require the input of energy in order to move the load and that by lifting-load is meant a load which requires the input of energy in order to be moved.

The aforesaid object is achieved by means of the inventive arrangement having the characteristic features set forth in the following Claims. In principle, the inventive arrangement can be characterized in that each inlet element consists of a control-pressure controlling valve mounted in the connection leading from pump to hydraulic motor and arranged to sense the pressure in the exhaust line of the hydraulic motor at a location between said motor and the outlet element mounted in the exhaust line and functioning as an adjustable seat valve which is controlled by the control pressure.

The inventive arrangement functions to relieve the pump of load automatically when the system is in a load-lowering mode, and therewith enables the pump flow to be used for other purposes, since in accordance with the present invention no pump pressure and pump flow are required to move lowering-loads, and considering that half of all the movements carried out by loaded hydraulic motors in hydraulic lifting arrangements consist of lowering movements a considerable gain in total energy is obtained.

The present invention will now be described in more detail with reference to the accompanying drawings, in which FIG. 1 is a block schematic of the hydraulic circuit of a hydraulic motor, including a valve arrangement constructed in accordance with this invention;

Figure 1:
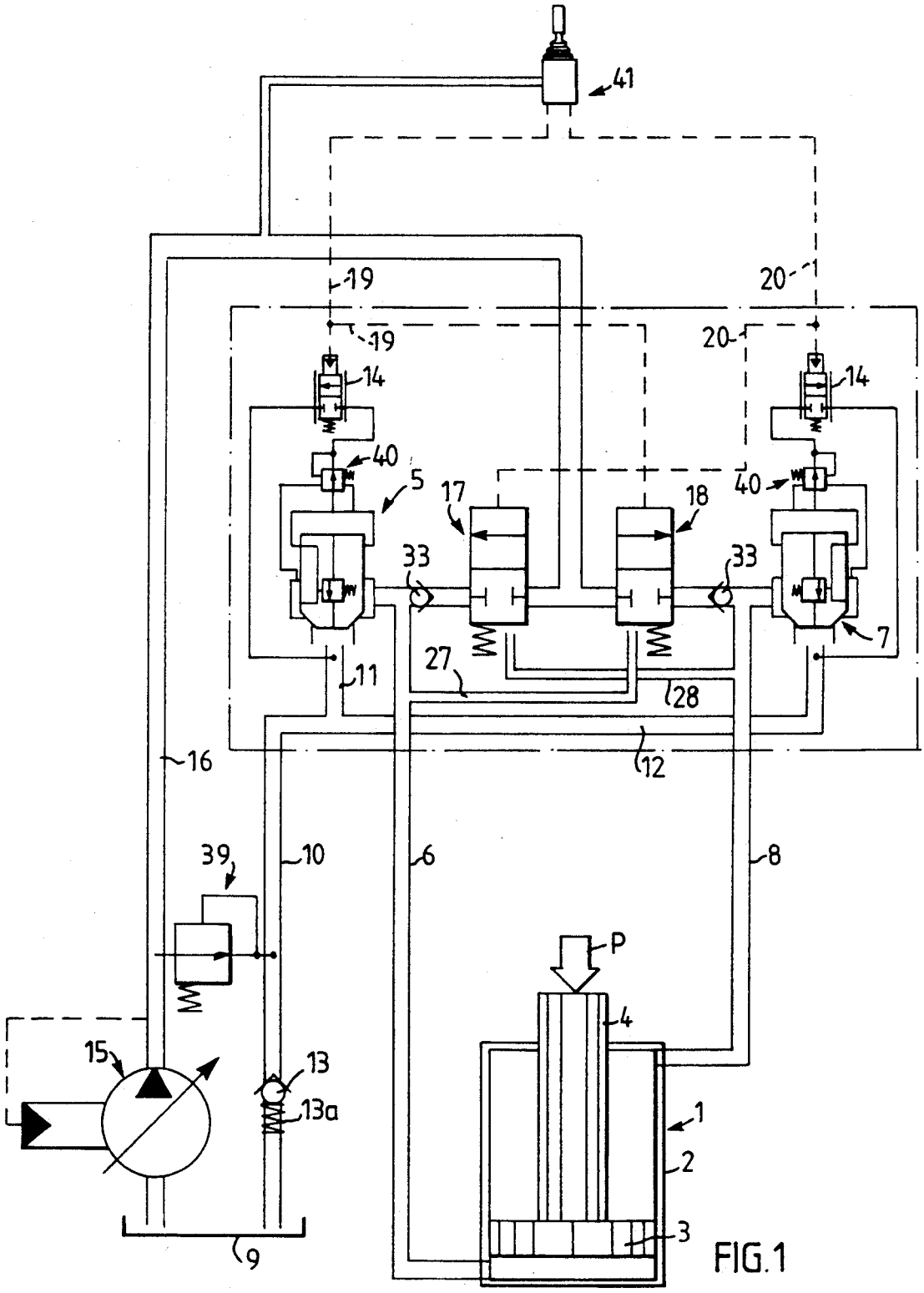

In the drawings, the reference numeral 1 identifies generally a hydraulic motor which, in the illustrated case, has the form of a hydraulic piston-cylinder device, comprising a cylinder 2, a piston 3 and associated piston rod 4. The hydraulic motor 1 is connected on its piston side with an outlet element through a line 6, and is connected on its piston-rod side to an outlet element 7, through a line 8. Each of the two outlet elements 5 and 7 is connected to a tank 9 by respective branch lines 11 and 12, which extend to a return line 10. Mounted in the return line 10 is a spring-loaded check valve 13 which opens in response to a given pressure in the return line 10, for example a pressure of 6 bars, said pressure being determined by the spring 13*a*.

The two outlet elements 5, 7 may consist of any known type of pressure-dependent or flow-dependent seat valve. The last mentioned type of valve is preferred for many reasons, however, and primarily because it enables the necessary inlet elements to be greatly simplified in comparison with the use of as outlet elements in the form of pressure-dependent seat valves. The drawings also show the use of pilot-flow-dependent seat valves as outlet elements, and more specifically the illustrated outlet elements 5, 7 have the form of pilot-flow-controlled seat valves retailed under the registered trademark "VALVISTOR". In the illustrated embodiment, these valves are pressure-compensated, as indicated schematically at 40, and the pilot valves 14 thereof are controlled by the control pressure.

The hydraulic circuit of the hydraulic motor includes a variable displacement pump 15, which is preferably, but not necessarily, pressure-controlled. The variable displacement pump 15 is connected by means of a supply line 16 to two inlet elements which, in the case of the illustrated embodiments of the present invention, have the form of valves 17 and 18 which are either pressure-loaded or fitted with a return spring, and which are controlled by control-pressure. In the case of the illustrated embodiments, each of the valves 17 and 18 functions as a slave valve to a respective outlet element 7 and 5. More specifically, the valve 18 functions as a slave valve to the outlet element 5, and the valve 17 functions as a slave valve to the outlet element 7.

The requisite control pressure to the pilot valve 14 of the outlet element 5 and to the slave valve 18 of said element is obtained through a control-pressure line 19, and correspondingly a control-pressure line 20 extends to the pilot valve 14 of the outlet element 7 and to the slave valve 17, these control-pressure lines 19, 20 being connected to the line 16 via a control lever or operating lever 41, as illustrated in FIG. 1. It is possible within the scope of the present invention to obtain the requisite control pressure for controlling the pilot valves 14 and the slave valves 17, 18 in some appropriate manner different to that illustrated in the drawings.

Each slave valve includes (FIG. 2) a valve slide 22 which is mounted for axial movement in a cylinder chamber 21 and which is held by means of a spring 23 in one end position against an abutment surface 24, for example in the form of a preferably detachable locking ring or stop ring. Thus, the control pressure is intended to act on the end surface 25 of the slide which faces towards this end position. The spring 23 acts against the other end surface 26 of the valve slide and this end surface is intended to detect the pressure in respective lines 6 and 8 extending from the cylinder 2 of the hydraulic motor to the outlet elements 5, 7 of respective slave valves. More specifically, the slave valve 18 detects the pressure in the line 6 extending from the hydraulic motor 1 to the outlet element 5 through a line 27, and the slave valve 17 detects the pressure in the line 8 extending from the hydraulic motor 1 to the outlet element 7, through a line 28.

Figures 2, 3:
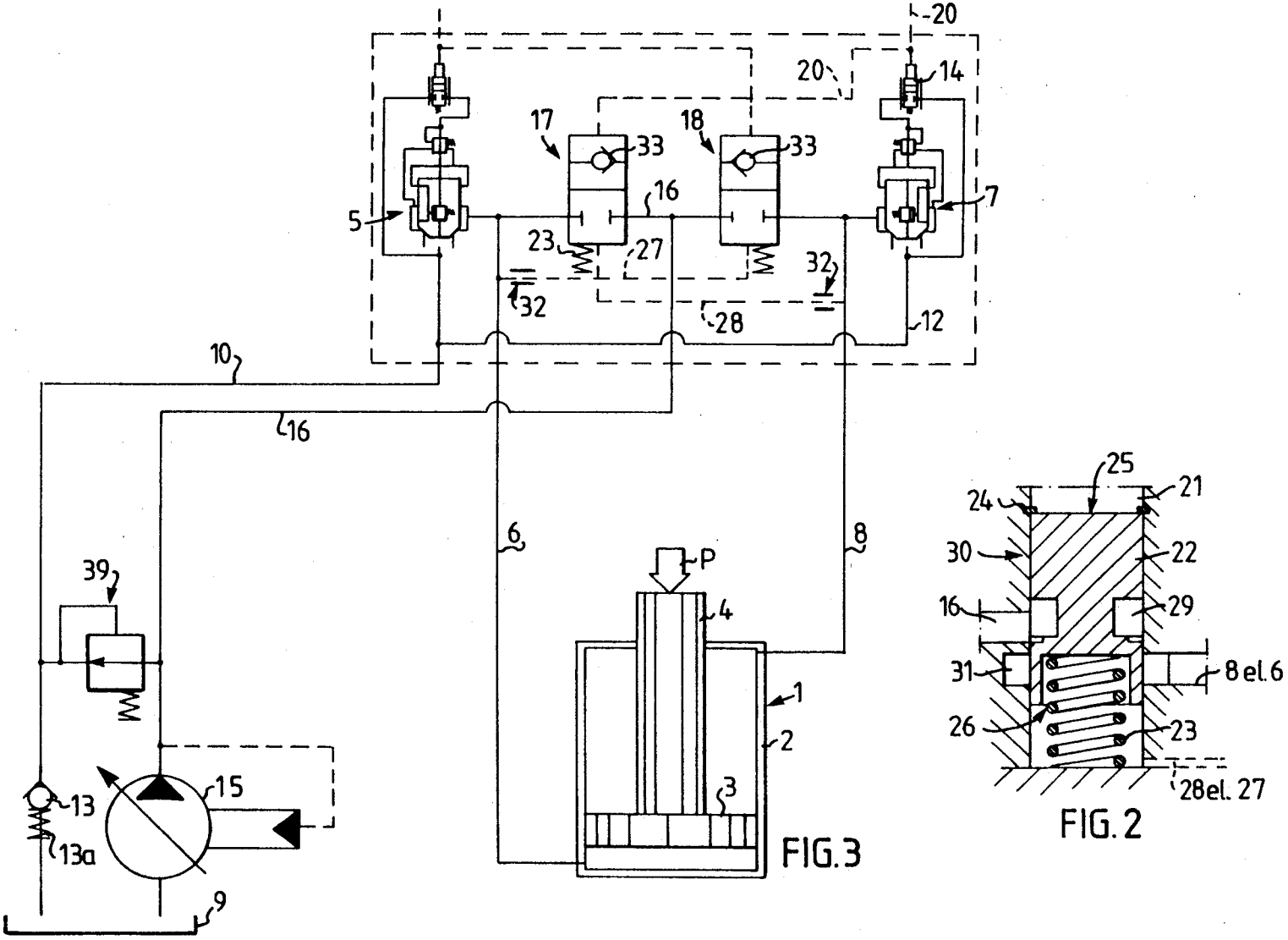
FIG. 2 is a sectional view of an inlet element included in said valve arrangement.
FIG. 3 is a block schematic similar to that shown in FIG. 1 and illustrates a loading occasion different to that shown in FIG. 1.

The slide 22 of each slave valve is provided between its end surfaces 25 and 26 with a circumferential groove 29 which is connected with the pressure line of the pump or the supply line 16 in the position illustrated in FIG. 2, which constitutes the closed position of the slave valve. Arranged in the valve housing 30 (not clearly shown in FIG. 2) of the slave valve is a groove 31 which surrounds the slide 22 and which connects with the cylinder 2 of the hydraulic motor through the line 8 with regard to the slave valve 18 and through the line 6 with regard to the slave valve 17 in the two embodiments of the inventive arrangement illustrated in the drawings.

Assume that the piston 3 of the hydraulic motor illustrated in FIG. 1 is acted upon by a lowering load P which gives rise to pressure, e.g. pressure of 100 bars, in the cylinder chamber or space on the piston side and that this pressure thus prevails in the exhaust line 6, provided that the outlet element 5 is closed. If the load P is now lowered, i.e. moved in the same direction as that in which the load acts, a control pressure is established in the control-pressure line 19 and this control pressure will cause the pilot valve of the outlet element 5 to open while the slave valve 18 of said element remains closed due to the fact that the applied control pressure is substantially lower than the detected pressure prevailing in the exhaust line 6. It can be mentioned, by way of example, that the requisite control pressure need not be higher than the pressure needed to displace the slave-valve slide 22 against the action of its spring 23 and therewith open the slave valve. A suitable control pressure is, for example, 10–25 bars.

Immediately when the pilot valve 14 opens, a pilot flow will pass through the outlet valve 5,.which functions as an adjustable throttle or constriction, which is therewith opened. By means of the proportional pilot valve 14, each outlet valve 5, 7 can be opened smoothly or continuously so as to allow fluid to flow from the line 6 to the branch line 11 and, due to the presence of the spring-loaded check valve 13 mounted in the return line 10, pressure is also obtained in the return line 10 and in the branch line 12 to the other outlet element 7, which also has the form of an outlet valve functioning as a variable throttle or constriction. The valve 7, similar to the valve 5, also functions as a check valve when the pressure on its input side is lower than the pressure on its output side, and therewith allows hydraulic fluid to pass through to the cylinder chamber of the hydraulic motor 1 on the piston-rod side thereof. Hydraulic fluid which is not used to fill the cylinder chamber on the piston-rod side passes through the return line 10 to the tank 9.

Although the control-pressure-free slave valve 17 is subjected to pressure in the line 8, through the detecting line 28, this pressure, in the aforementioned case, only functions as a closing pressure and thus assists the spring 23 in holding the slave valve 17 closed.

It will be understood from the aforegoing that the pump 15 need not be used to move a lowering-load in the loading direction, and that the pump is automatically relieved of load, therewith saving fluid flow and energy associated therewith.

If the load P acting on the piston 3 of the hydraulic motor is to be raised, it is ensured that the control pressure is established in the line 20 (FIG. 3), this control pressure in turn ensuring that the pilot valve 14 of the outlet valve 7 will open, and that the slave valve 17 of said outlet valve 7 will open against the action of the spring 23, and possibly also against pressure prevailing in the detecting line 28. When the slave valve 17 is activated by the control pressure, the slide 22 of said valve is moved so that the supply line 16 extending from the pump 15 is caused to communicate with the line 6 leading to the cylinder chamber of the hydraulic motor on the piston side thereof. The piston 3 of the hydraulic motor is therewith subjected to the force of said pressure and will thus be displaced axially immediately the outlet element or valve 7 permits hydraulic fluid to flow from the cylinder chamber on the piston-rod side of the hydraulic motor through said valve itself and to the line 12 and therewith through the return line 10 to the tank 9. Since the outlet valve 7 can be adjusted continuously between a fully closed and a fully opened position, the flow leaving the hydraulic motor 1 can also be controlled smoothly and continuously, and therewith also the speed at which the load is to be moved.

In order to prevent abrupt increases in pressure in the detecting lines 27, 28 of the slave valves, each of said lines may be provided with a respective constriction 32 for damping any such radical increase in pressure, so that the valve slide 22 of the slave valve will not be displaced unintentionally.

Figure 4:
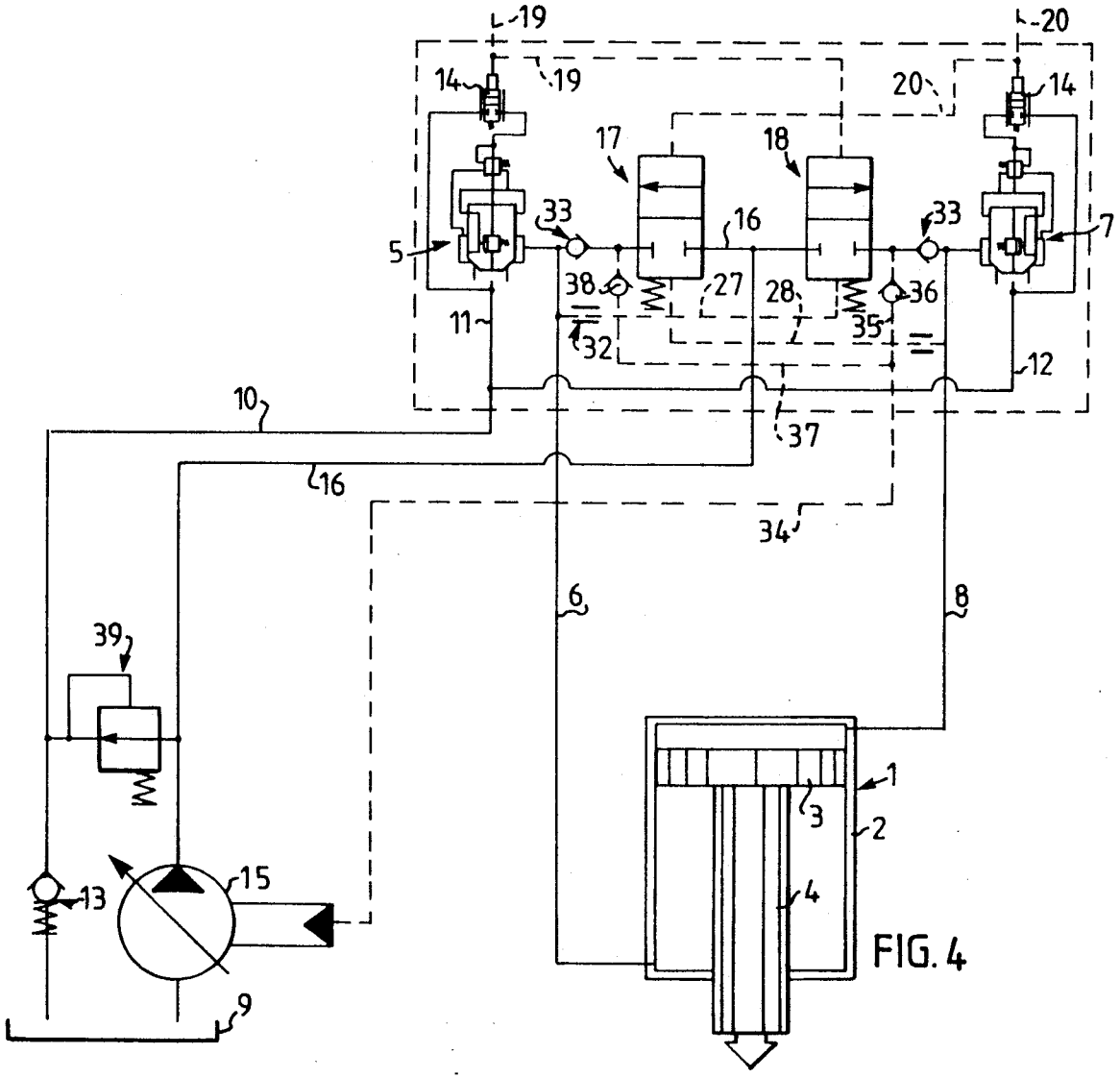
FIG. 4 is a block schematic of a further hydraulic circuit which incorporates the inventive arrangement, and illustrates a further loading occasion.
Figure 5:
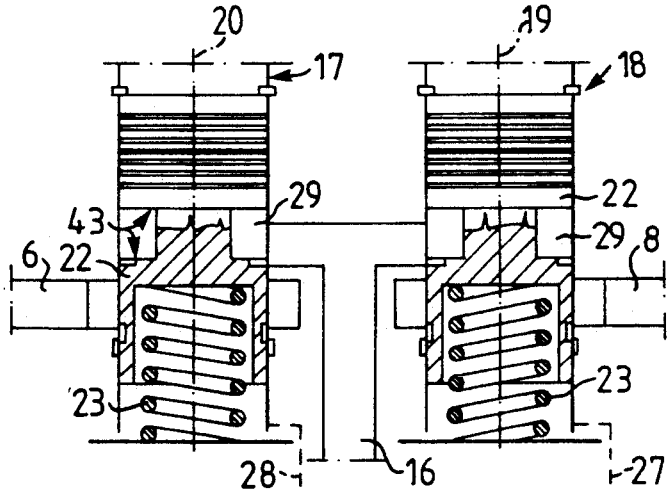
FIG. 5 is a sectional view of the two inlet elements included in the arrangement illustrated in FIG. 4.

FIGS. 4 and 5 illustrate an embodiment of the inventive arrangement in which the hydraulic motor 1 is turned through 180° in relation to the hydraulic motor illustrated in remaining Figures, and is assumed to be subjected to a tensile load or pulling load P. The embodiment illustrated in FIG. 4 and also the embodiment illustrated in FIG. 1 differ from the embodiment illustrated, in FIG. 3 in that the check valves 33 of the slave valves are arranged outside respective slave valves 17, 18 instead of within said valves, as the symbol used in FIG. 3 indicates. In the case of the FIG. 4 embodiment, the check valves 33 are placed externally of respective slave valves because the pump 15 is remotely pressure-controlled on the basis of the pressure delivered by respective slave valves 17, 18, and consequently the pump 15 is connected to the two slave valves 17, 18 through a line 34 which branches into a line 35, which is provided with a check valve 36 and is connected to the line 8 at a location between the slave valve 18 and its check valve 33, and into a line 37 which is provided with a check valve 38 and which is connected to the line 6 at a location between the slave valve 17 and its check valve 33. Thus, the check valves 38 and 36 provided in the branch lines 35 and 37 of the load detecting line 34 are intended to prevent the flow of hydraulic fluid from the line 8 to the line 6, and vice versa.

Furthermore, the FIG. 4 embodiment includes a pressure-reducing valve 39 which is set to a lower pressure than the check valve 13 in the return line 10. In this case, if the piston 3 of the hydraulic motor 1 is to be displaced in the same direction as the direction in which the tensileor pulling force P acts, a control pressure is generated in the control-pressure line 19 leading to the pilot valve 14 of the outlet element 5 and to the slave valve 18. This control pressure causes the outlet valve 5 to open and to allow hydraulic fluid to pass through to the line 11 and therewith to the line 12 leading to the other outlet valve 7 which, as before mentioned, functions as a check valve when the pressure in the outlet of valve 7, i.e. the pressure in the line 12, is greater than the pressure at the inlet of said valve 7, i.e. the pressure in the line 8, and thus allows the fluid in the line 12 to pass through to the line 8, so as to fill the cylinder chamber on the piston side of the hydraulic motor. As a result of the presence of this spring-loaded check valve 13 in the return line 10, pressure is maintained in both the return line 10 and in the lines 11, 12 and 8, and also in the cylinder chamber on the piston side. However, because this cylinder chamber has a larger cross-sectional area than the cylinder chamber on the piston-rod side, the flow of fluid from the cylinder chamber on the piston-rod side is not sufficient volumetrically to fill the cylinder chamber on the piston side and the pressure will therewith fall automatically in the lines 10, 11, 12 and 8 and also in the cylinder chamber on the piston side. When this pressure is roughly equal to the pressure to which the pressure-reducing valve 39 is set and is lower than the holding pressure of the check-valve 13 in the return line 10, the pressure-reducing valve 39 enables fluid to flow from the line 16 to the line 10, through said valve 39, so as to balance-out the volumetric deficiency and therewith prevent the occurrence of subpressure and therewith cavitation in the cylinder chamber on the piston side of the hydraulic motor.

Considerable energy is also saved in this loading occasion, in comparison with known technology.

If the piston 3 of the hydraulic motor is to be moved in the opposite direction to which the load P acts, for example, in the embodiment illustrated in FIG. 4, the inlet element 17 is opened with the aid of the operating lever 41 such as to allow fluid to flow through the inlet opening 17 from the pump 15, and since the pressure is, in this case, substantially higher on the inlet side of the outlet element 5 than on its outlet side, the outlet element 5 remains closed and the outflow through the inlet element 17 is conducted by the line 6 into the cylinder 2 of the hydraulic motor 1 on its piston-rod side. The pilot valve 14 of the outlet element 7 is acted upon by the same control pressure as the inlet element 17, and the pilot valve will therewith open to allow a pilot flow to pass therethrough, such as to open the outlet element 7 smoothly and continuously, in a known manner, which therewith connects the line 8 from the hydraulic motor 1 to the return line 12, 10 leading to the tank 9. It shall be noted in this respect that since mutually opposing, exposed surfaces 43 within the circumferentially extending groove 29 in the valve slides 22 of respective inlet elements 17, 18 are of mutually equal size, the slide 22 of the inlet element 17, 18 is not activated in any direction by the pump pressure, since forces contingent on the pump pressure cancel each other out.

It will be understood that the present invention is not restricted to the aforedescribed and illustrated embodiments thereof, since modifications and changes can be made in many ways within the scope of the inventive concept defined in the following Claims. For example, the valves 17 and 18, which in normal instances function as conventional inlet elements or inlet valves, may be of the same kind as the outlet valves used.

I claim:

1. An arrangement for controlling a hydraulic motor having two sides, comprising;

a plurality of spring-based pressure-controlled inlet element and a plurality of outlet elements arranged in a hydraulic circuit which connects the hydraulic motor with a tank and with a pump that functions as a power source for the hydraulic motor;

each of said inlet elements being connected in the hydraulic circuit between an outlet of the pump and the hydraulic motor;

each of said outlet elements being connected in the hydraulic circuit between the hydraulic motor an inlet of the tank;

each inlet element being biased on one end by a control pressure and biased on another end which is opposite said one end by a spring and a hydraulic pressure to control the inlet element, said hydraulic originating from the hydraulic circuit at a position on one side of the hydraulic motor, said one side being opposite to a side of the hydraulic motor where said inlet element is connected in said hydraulic circuit;

means for independently changing each of said inlet elements from an inactive state to an active state by separately applying said control pressure to said one end of said inlet element which is opposite said spring biased end;

means for directing flow to the hydraulic motor so as to maintain said hydraulic pressure when a force against said spring biased end of one of said inlet elements in lower than the force against said opposite end of said one inlet element from said control pressure;

means for closing said one inlet element and unloading the pump when said force from said hydraulic pressure and said spring against said spring biased end of said one inlet element is higher than the force against said opposite end of said one inlet element from said control pressure.

2. An arrangement according to claim 1, wherein each outlet element is controlled by the same control pressure through the medium of an associated pilot valve simultaneously with is associated inlet element.

3. An arrangement according to claim 1, wherein each inlet element includes a moveable valve slide for detecting the pressure prevailing in the hydraulic circuit between said hydraulic motor and the outlet element, wherein said respective inlet elements are connected to a line which functions as an exhaust line from the hydraulic motor between said motor and as associated outlet element through a detecting line, through which detecting line the valve slides of respective inlet elements are subjected to the detected pressure on an end surface thereof opposite to another end surface thereof against which the control pressure acts.

4. An arrangement according to claim 3, wherein the valve slide of the inlet element is spring-biased towards a closed position on the same side as that on which the detecting pressure acts.

5. An arrangement according to claim 3, wherein a constriction functioning to dampen occurrent pressure surges is arranged in each detecting line.

6. An arrangement according to claim 1, characterized in that the outlet elements are each connected to a common return line leading to the tank, via a respective branch line.

7. An arrangement according to claim 6, wherein the return line leading to said tank incorporates a spring-loaded check valve which functions to maintain a relatively low pressure in said return line.

8. An arrangement according to claim 1, characterized by a pressure-reducing valve which is mounted between the connection from the pump to the hydraulic motor and the return line common to said outlet elements, said pressure-reducing valve being set to a pressure which is lower than the pressure that can be maintained by a spring-loaded check valve in the return line.

9. An arrangement according to claim 1, wherein at least the outlet elements comprise pilot-flow-controlled seat valves of the kind which functions as a check valve when the pressure on the input side thereof is lower than the pressure on the output side thereof.

10. An arrangement according to claim 9, wherein said seat valves are pressure compensated.

11. A device for controlling a hydraulic system including a tank for storing hydraulic fluid and a pump for pumping hydraulic fluid from the tank to a hydraulic motor having a first side and a second side, said device comprising:

a first inlet valve and a second inlet valve arranged in parallel with said pump;

a first outlet valve and a second outlet valve arranged in parallel with said tank, said first outlet valve arranged in series with said first inlet valve and said second outlet valve arranged in series with said second inlet valve;

said first side of said hydraulic motor connected between said first inlet valve and said first outlet valve;

said second side of said hydraulic motor connected between said second inlet valve and said second outlet valve;

means for automatically controlling said inlet valves and said outlet valves to bypass hydraulic fluid around said pump when an external load is applied to one side of said hydraulic motor in a direction of movement of said hydraulic motor; and wherein each of said inlet valves includes a valve slide which is biased on one end by a control pressure and biased on another end which is opposite said one end by a spring and a hydraulic pressure from one side of said hydraulic motor.

12. A device as claimed in claim 11, wherein said first inlet valve is biased on its other end by a hydraulic pressure from said second side of said hydraulic motor and wherein said second inlet is biased on its other end by a hydraulic pressure from said first side of said hydraulic motor.

13. A device for controlling a hydraulic system including a tank for storing hydraulic fluid and a pump for pumping hydraulic fluid from the tank to a hydraulic motor including a piston and a rod arranged inside a cylinder, said device comprising:

a first inlet valve and a second inlet valve arranged in parallel with said pump, each of said inlet valves including a valve slide which is biased on one end by a control pressure and biased on another end which is opposite said one end by a spring and a hydraulic pressure from one side of said hydraulic motor;

a first outlet valve and a second outlet valve arranged in parallel with said tank, said first outlet valve arranged in series with said first inlet valve and said second outlet valve arranged in series with said second inlet valve;

a piston side of said hydraulic motor connected between said first inlet valve and said first outlet valve;

a rod side of said hydraulic motor connected between said second inlet valve and said second outlet valve; and means for automatically controlling said inlet valves and said outlet valves to bypass hydraulic fluid around said pump when an external load is applied to one side of said hydraulic motor in a direction of movement of said hydraulic motor.

14. A device as claimed in claim 13, wherein each of said outlet valves includes a pilot-flow-controlled seat valve.

15. A device as claimed in claim 14, wherein said pilot-flow-controlled seat valves operate as a check valve.

16. A device as claimed in claim 15, wherein said pilot-flow-controlled seat valves are pressure compensated.

17. A device as claimed in claim 13, further comprising a pressure reducing valve connected in parallel with said first inlet valve and said first outlet valve.

18. A device for controlling a hydraulic system including a tank for storing hydraulic fluid and a pump for pumping hydraulic fluid from the tank to a hydraulic motor including a piston on a rod inside a cylinder, said device comprising:

a first inlet valve and a second inlet valve arranged in parallel with said pump, each of said inlet valves including a valve slide which is biased on one end by a control pressure and biased on another end which is opposite said one end by a spring and a hydraulic pressure from one side of said hydraulic motor, said first inlet valve being biased on its other end by a hydraulic pressure from said rod side of said hydraulic motor and said second inlet being biased on its other end by a hydraulic pressure from said piston side of said hydraulic motor;

a first outlet valve and a second outlet valve arranged in parallel with said tank, said first outlet valve arranged in series with said first inlet valve and said second outlet valve arranged in series with said second inlet valve;

a piston side of said hydraulic motor connected between said first inlet valve and said first outlet valve;

a rod side of said hydraulic motor connected between said second inlet valve and said second outlet valve;

a pressure reducing valve connected in parallel with said first inlet valve and said first outlet valve; and means for automatically controlling said inlet valves and said outlet valves to bypass hydraulic fluid around said pump when an external load is applied to one side of said hydraulic motor in a direction of movement of said hydraulic motor.

* * * * *